US005759309A

United States Patent [19]

Watts et al.

[11] Patent Number: 5,759,309

[45] Date of Patent: Jun. 2, 1998

[54] THERMAL PROCESS FOR SELECTIVELY HARDENING TRACK CHAIN LINKS

[75] Inventors: Kenneth R. Watts, Washington; Gary L. Biltgen, Peoria; David E. Bowman, East Peoria; Charles F. Berndt, Pekin, all of Ill.

[73] Assignee: Caterpillar Inc., Peoria, Ill.

[21] Appl. No.: 704,202

[22] Filed: Aug. 28, 1996

[51] Int. Cl.[6] ..... C21D 1/06

[52] U.S. Cl. ..... 148/637; 148/638; 148/644; 148/660; 148/714

[58] Field of Search ..... 148/637, 638, 148/644, 658, 660, 713, 714

[56] References Cited

U.S. PATENT DOCUMENTS 2,890,975 6/1959 Lenz ..... 148/644
4,596,612 6/1986 Fradique ..... 148/713
5,419,792 5/1995 King et al. ..... 148/714

FOREIGN PATENT DOCUMENTS 5-9488 2/1993 Japan .

*Primary Examiner*—George Wyszomierski
*Attorney, Agent, or Firm*—Pankaj M. Khosla

[57] ABSTRACT

A process for selectively hardening a forged track chain link has the following steps. A forged track chain link having a pad portion, a rail portion, a first side portion and a second side portion, is provided. A quench tank is provided and adapted for spraying one or more of the track chain link portions with a quenchant at a controlled amount of quenchant flow rates, quenchant pressures and quench times. One or more of the track chain link portions are sprayed with the quenchant at a controlled amount of one or more of a plurality of quenchant flow rates, a plurality of quenchant pressures and a plurality of quench times. The pad and rail portions are simultaneously hardened to predetermined respective hardnesses.

23 Claims, 3 Drawing Sheets

THERMAL PROCESS FOR SELECTIVELY HARDENING TRACK CHAIN LINKS

TECHNICAL FIELD

The present invention relates to a process for the thermal treatment of forged track chain links used in track-type earthworking machines and more particularly, to a process for selectively hardening portions of the forged track chain links by selective quenching and tempering of portions of the link.

BACKGROUND ART

Track chain links used in the tracks of a track type machine are well known in the industry. A track chain link has a upper portion, or the pad portion and a lower portion, or the rail portion. It is important that the rail portion of the track chain link have high surface hardness whereas the pad portion of the track chain link can have lower surface hardness. A high surface hardness in the rail portion is necessary because the rail portion is subjected to severe wear due to continuous contact with the track rollers.

Various methods are known for hardening a track chain link. One such method is disclosed in a Japanese Patent Publication No. HEI 5-9488 dated Feb. 5, 1993 by Kabushiki Kaisha Komatsu Seisakusho. The '9488 publication discloses a hardening method of a track shoe link. The process includes hardening the lower face portion (rail portion) and the upper portion (pad portion) of a track chain link separately although simultaneously, by water spraying to obtain a martensitic structure in the lower face portion (rail portion) and a bainitic structure in the upper portion (pad portion) of the track chain link. One drawback of this process is that the lower face portion and the upper portion of the track chain link have to be separated or shut off, from each other, through an additional closing plate. This additional step results in an unnecessary expense of time, labor, resources and equipment.

It has been desirable to have a process where the rail and pad portions of a forged track chain link are selectively hardened to predetermined levels of hardness in a single step involving quench and tempering and without the additional need for a physical barrier to shut off the quenchant flow to the rail portion from the quenchant flow to the pad portion of the track chain link. It has also been desirable to simultaneously quench and temper predetermined portions of a forged track chain link by providing a controlled amount of quenchant, at a controlled pressure and for a controlled amount of time, to obtain predetermined levels of surface hardness and depth of hardness. It has yet further been desirable to have a process for selectively hardening forged track chain links without an additional step of induction hardening. It has still further been desirable to have a thermal process for selectively hardening track chain links where it is not critical to maintain a bainitic microstructure in the pad portion of the track chain link.

The present invention is directed to overcome one or more of the problems in the heretofore processes as set forth above.

DISCLOSURE OF THE INVENTION

In one aspect of the invention, a process for selectively hardening a forged track chain link has the following steps. A forged track chain link is provided. The track chain link has a pad portion, a rail portion, and first and second side portions. A quench tank adapted for receiving the track chain link is provided. The quench tank is adapted for spraying one or more of the track chain link portions with a quenchant at a controlled amount of one or more of a plurality of quenchant flow rates, a plurality of quenchant pressures and a plurality of quench times. The forged track chain link is placed within the quench tank. One or more of the pad portion, the rail portion, and first and second side portions is sprayed with the quenchant. The quenchant is provided at a controlled amount of one or more of a plurality of quenchant flow rates, a plurality of quenchant pressures and a plurality of quench times. The pad and rail portions of the track chain link are hardened to predetermined respective hardnesses. The rail portion is hardened to a surface hardness greater than the surface hardness of the pad portion.

BEST MODE FOR CARRYING OUT THE INVENTION

In the preferred embodiment of the present invention, a process for selectively hardening a forged track chain link comprises the step of providing a forged track chain link having a pad portion, a rail portion, a first side portion and a second side portion. The forged track chain link has an austenitic microstructure upon forging. Immediately upon forging, the forged track chain link desirably has a temperature in the range of about 1500° F. to about 1700° F. Each of the pad portion, the rail portion, the first side portion and the second side portion of the track link include a bushing section, a strut section and a pin section, respectively. The pad portion and the first and second side portions are generally referred to as the body of the track link. Track links of this general configuration are well known in the industry, especially the track type vehicle industry.

In the preferred embodiment of the present invention, a cooling tank is provided. A cooling tank is adapted for receiving the track chain link. The cooling tank is also adapted for spraying one or more of the track link portions with a quenchant at a controlled amount of one or more of a plurality of quenchant fluids, a plurality of quenchant pressures and a plurality of quench times. Preferably, the quench tank is adapted for distributing the quenchant to a plurality of quench zones. The quenchant is provided to each quench zone with a controlled amount of one or more of quenchant flow rate, quenchant pressure and quench time. In the preferred embodiment, the quench tank is adapted for distributing the quenchant to twelve quench zones.

Figure 1:
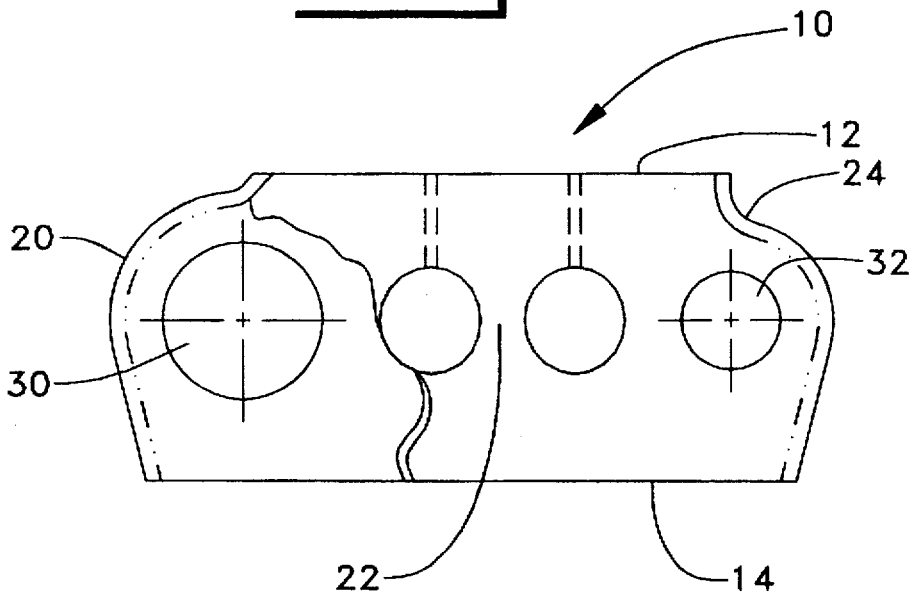
FIG. 1 is an illustrative representation of a side view of a track chain link.
Figure 2:
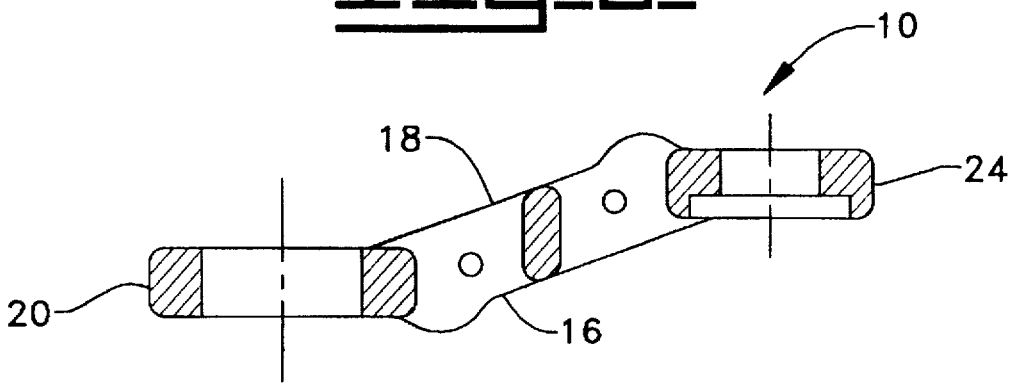
FIG. 2 is a plan view, in section, of the track chain link shown in FIG. 1.
Figure 5:
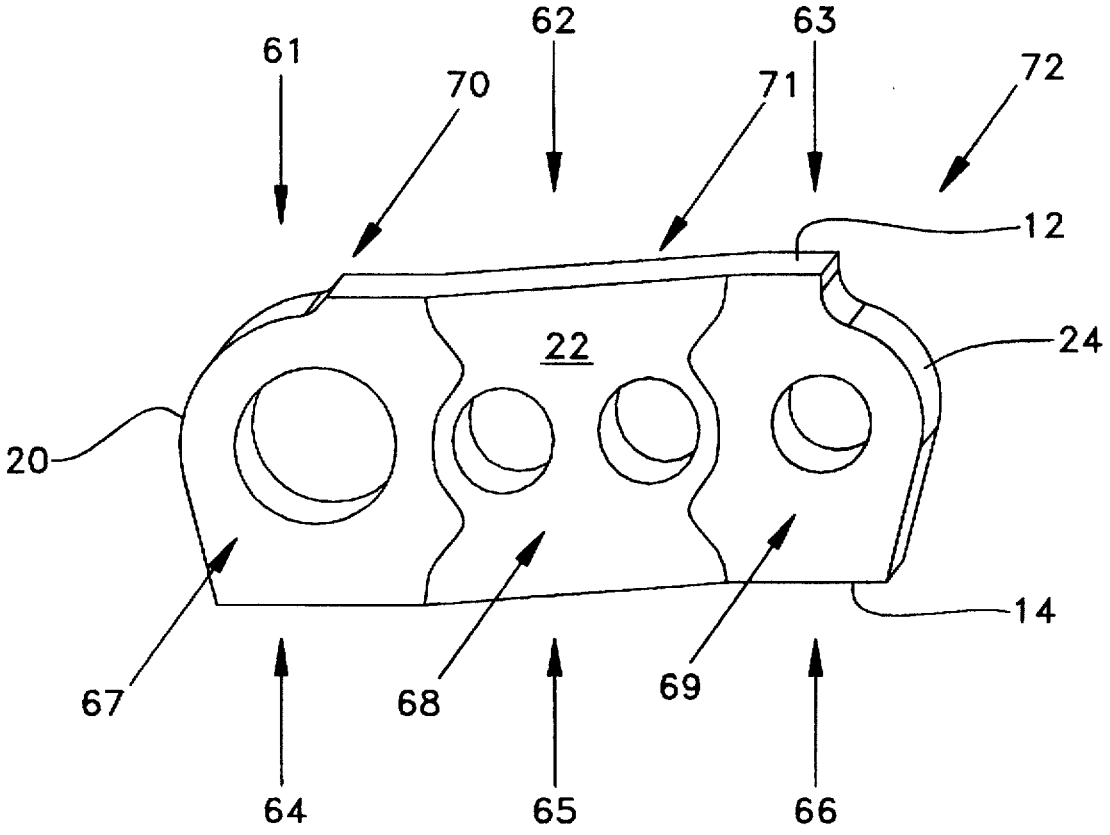
FIG. 5 is a three-dimensional illustrative representation of the various quench zones for carrying out an embodiment of the process of the present invention.

Referring now to FIGS. 1 and 2 which show the side view and the plan view, in section, of a track chain link 10, and FIG. 5, the first, second and third quench zones 61,62,63 respectively constitute the bushing section 20, the strut section 22 and the pin section 24 of the pad portion 12, respectively. Likewise, the fourth, fifth and sixth quench zones 64,65,66 respectively constitute the bushing section 20, the strut section 22 and the pin section 24 of the rail portion 14, respectively. In a similar manner, the seventh, eighth and ninth quench zones 67,68,69 respectively constitute the bushing section 20, the strut section 22 and the pin section 24 of the first side portion 16, respectively, and the tenth, eleventh and twelfth quench zones 70,71,72 respectively constitute the bushing section 20, the strut section 22 and the pin section 24 of the second side portion 18, respectively. The bushing section 20 has a bushing hole 30 and the pin section 24 has a pin hole 32.

In the preferred embodiment, each of the bushing, strut and pin sections 20,22,24 respectively, of the pad 12, the rail 14, the first side and second side portions 16,18 of the track chain link 10, respectively are sprayed with the quenchant. The spraying of the quenchant is done at a controlled amount of one or more of a plurality of quenchant flow rates, a plurality of quenchant pressures and a plurality of quench times.

Figure 3:
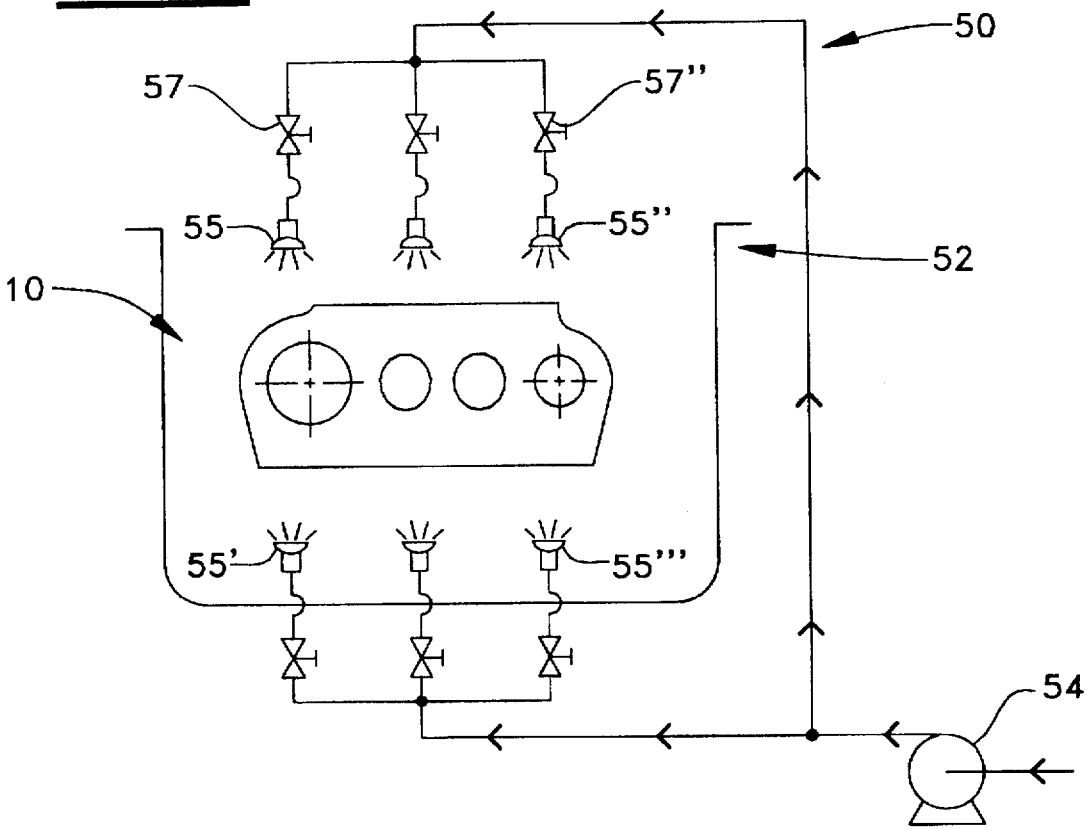
FIG. 3 is an illustrative representation of the side view of an apparatus for carrying out an embodiment of the process of the present invention.
Figure 4:
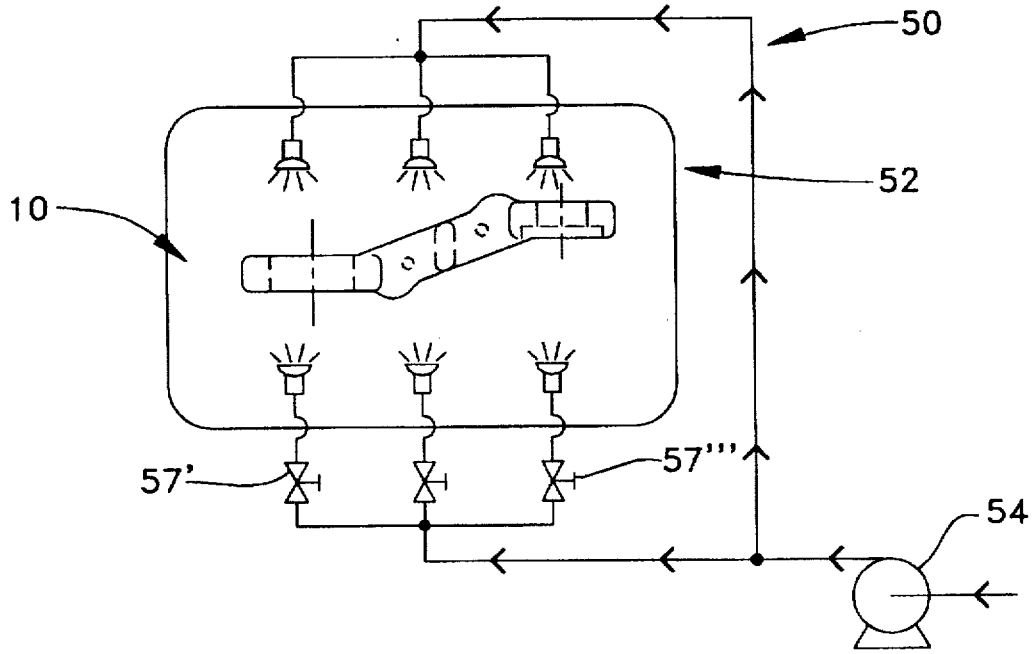
FIG. 4 is a plan view of the apparatus shown in FIG. 3.

Referring now to FIGS. 3 and 4 which show a schematic of the apparatus 50 for carrying out the process of the present invention, the quench pattern for each of the twelve zones is shown. In the preferred embodiment, the quenchant is supplied to the quench tank 52 via a quenchant supply pump 54. Various types of pumps such a reciprocating, positive displacement or centrifugal pumps can be used. These are well known to those skilled in the art and need not be described in further detail. All of the twelve zones are preferably supplied with a total volumetric flow rate in the range of about 400 gallons per minute (g.p.m.) to about 600 g.p.m., however, preferably the flow rate to each individual quench zone can vary depending upon the desired hardness to be attained in the selected portion of the track chain link.

In the preferred embodiment the quenchant is provided to each of the quench zones by a pump operating at a preselected pump speed. Preferably the quenchant is supplied to each quench zone at an individual pressure which is dependant upon the flow rate of the quenchant and the size of the nozzle orifice 55 through which the quenchant is sprayed. These parameters are variable, they depend upon the degree of quenching required, and can be determined by one skilled in the art without undue experimentation. In the preferred embodiment the quench times for each quench zone can be varied depending upon the desired predetermined hardness to be attained in the track chain link portions. The quenchant spray can be turned on or off by valves 57 which are well known to those skilled in the art, such as solenoid valves and actuators, which are energized by a power source and programmed to turn on or off at predetermined intervals and for predetermined periods of time through a programmable logic controller (PLC). Such systems are well known to those skilled in the art and need not be described in further detail.

In the preferred embodiment of the present invention, each of the bushing, strut, and pin sections of the pad portion, respectively are sprayed with quenchant at a quenchant flow rate desirably in the range of about 10 gallons per minute to 50 gallons per minute at a quenchant pressure desirably in the range of about 2 psi to about 5 psi and at a quench time desirably in the range of about 1 second to about 15 seconds. Preferably the bushing section of the pad portion is sprayed for a quench time in the range of about 1 second to about 5 seconds. It is undesirable to spray for a time less than about 1 second or greater than about 5 seconds because the surface hardness and the hardened depth of the bushing section are detrimentally affected. Preferably the strut section of the pad portion is sprayed for a quench time in the range of about 9 seconds to about 15 seconds. A quench time less than 9 seconds or greater than 15 seconds is undesirable because the surface hardness and the hardened depth of the strut section are detrimentally affected. Preferably the pin section of the pad portion is sprayed for a quench time in the range of about 3 seconds to about 8 seconds. A quench time less than about 3 seconds or greater than about 8 seconds is undesirable because the surface hardness and the hardened depth of the pin section are detrimentally affected.

In the preferred embodiment of the present invention, each of the bushing, strut and pin sections of the rail portion, respectively are sprayed with quenchant at a quenchant flow rate and desirably in the range of about 70 g.p.m. to about 100 g.p.m. at a quenchant pressure desirably in the range of about 5 psi to about 15 psi and a quench time desirably in the range of about 90 seconds to about 210 seconds. It is desirable to quench the rail portion of the track link for a quench time in the range of 90 to 200 seconds as compared to quenching the pad portion of the track link for a quench time in the range of about 1 second to 15 seconds because it is very important to obtain a fully quenched rail portion which results in a martensitic microstructure upon completion of the quench. It is important not to fully quench the pad portion so that the pad portion of the track link retains some residual heat which is utilized to then temper the pad portion and to result in a tempered martensitic microstructure up to a depth of about 3 mm to 12 mm below the surface. In the preferred embodiment, the bushing section of the rail portion is sprayed for a quench time preferably in the range of about 90 seconds to about 110 seconds. A quench time less than 90 seconds or greater than about 110 seconds is undesirable because the surface hardness and the hardened depth are detrimentally affected. The strut section of the rail portion is sprayed for a quench time preferably in the range of about 155 seconds to about 185 seconds. A quench time less than 155 seconds or greater than about 185 seconds is undesirable because the surface hardness and the hardened depth are detrimentally affected. The pin section of the rail portion is sprayed for a quench time preferably in the range of about 190 seconds to about 210 seconds. A quench time less than 190 seconds or greater than 210 seconds is undesirable because the surface hardness and the hardened depth are detrimentally affected.

In the preferred embodiment, each of the bushing, the strut and the pin sections of each of the first side portions and the second side portions, respectively of the track link are sprayed with a quenchant at a quenchant flow rate desirably in the range of about 30 gallons per minute to about 60 gallons per minute at a quenchant pressure in the range of desirably about 1 psi to about 10 psi and a quench time desirably in the range of about 1 second to about 15 seconds. In the preferred embodiment, each of the bushing sections of the first and second side portions of the track link are respectively sprayed for a quench time preferably in the range of about 1 second to about 5 seconds. A quench time less than about 1 second or greater than about 5 seconds is undesirable because the surface hardness and the hardened depth are detrimentally affected. In the preferred embodiment, each of the strut sections of the first and second side portions, respectively are sprayed for a quench time desirably in the range of about 9 second to about 15 seconds. A quench time less than about 9 seconds or greater than about 15 seconds is undesirable because the surface hardness and the hardened depth are detrimentally affected. In the preferred embodiment, each of the pin sections of the first and second side portions, respectively of the track link are sprayed for a quench time preferably in the range of about 3 seconds to about 8 seconds. A quench time less than about 3 seconds or greater than about 8 seconds is undesirable because the surface hardness and the hardened depth are detrimentally affected.

A quenchant flow rate less than about 10 gallons per minute or greater than about 50 gallons per minute to the pad portion is undesirable because if the flow rate is less than about 10 gallons per minute, too little cooling will occur and if the flow rate is more than 50 gallons per minute, detrimentally excessive cooling will result causing an undesirably excessive quenching of the pad portion. A quenchant flow rate in the range of about 70 gallons per minute to about 100 gallons per minute is desirable for spraying the rail portion because if the flow rate is less than 70 gallons per minute, a detrimentally less cooling will occur and detrimentally less quenching will occur which will result in a less than substantially martensitic microstructure. A flow rate greater than 100 gallons per minute is undesirable because it represents a waste of resources.

In the preferred embodiment, the quenchant used is desirable one of water, organic heat transfer fluid, a polymeric heat transfer fluid or mixtures thereof. Preferably the quenchant is a mixture of water and a polymeric heat transfer fluid such as polyalkylene glycol. In the preferred embodiment, the quenchant has a temperature in the range of about 90° F. to about 120° F. and preferably in the range of about 93° F. to about 98° F. A quenchant temperature less than about 90° F. is undesirable because it will cause too rapid quenching of the track links. A quenchant temperature greater than about 120° F. is undesirable because excessively long quenching time will result in a reduced quenching severity, thereby detrimentally resulting in a lowered surface hardness and hardened depth.

In the preferred embodiment of the present invention, the bushing, strut and pin sections of the pad portion, respectively have surface temperatures in the range of from about 190° F. to about 310° F., from about 150° F. to about 195° F. and from about 195° F. to about 245° F., respectively. The pad portion desirably has a martensitic microstructure at time "t" immediately after being sprayed with the quenchant. After the track link has been removed from the quench tank and after a period of time in the range of about (t+5) minutes to about (t+10) minutes has passed, the surface temperature of the pad portion rises to a temperature in the range of about 750° F. to about 950° F. This rise in temperature occurs due to the partial quench of the pad portion and this partial quenching causes the residual heat in the pad portion to temper the pad portion in order to obtain a tempered martensitic microstructure after the pad portion has cooled down to room temperature. Further, it is desirable to do a partial quench as shown above because the tempered martensitic microstructure results in the pad portion having a Rockwell C hardness in the range of about 33 $R_c$ to about 41 $R_c$. The Rockwell hardness less than about $R_c$ 33 is undesirable because the pad portion would be too soft for the intended application as a track link and would be susceptible to excessive wear and deformation. The Rockwell hardness of greater than about $R_c$ 41 is undesirable because the track chain link would not have the required ductility.

In the preferred embodiment of the preferred invention, the rail portion has a surface temperature in the range of from about 105° F. to about 145° F. At a time "t" immediately after being sprayed with the quenchant, the rail portion also has a martensitic microstructure at time "t". After the track chain link is removed from the quench tank and after a period of time in the range of about (t+5) minutes to about (t+10) minutes has elapsed, the surface temperature of the rail portion rises to a temperature in the range of about 250° F. to about 400° F. Due to the slight amount of residual heat in the rail portion, as the rail portion cools down to room temperature it is very slightly tempered to release a little brittleness and to improve the ductility in the rail portion. It must be understood that it is critical to limit the quenching of the rail portion to the above times because if the rail portion has a temperature greater than about 400° F., detrimentally excessive tempering would result and detrimental reduction in the hardness in the rail portion would result. It is thus important that the temperature of the rail portion be within the range of 250° F. to about 400° F. to obtain a final Rockwell hardness of at least $R_c$ 50. A hardness less than $R_c$ 50 is undesirable because it will reduce the wear resistance of the rail portion. A hardness greater than about $R_c$ 60 is undesirable because it will decrease the spalling resistance of the rail portion. Although the desired hardness of the rail portion may range from about $R_c$50 to about $R_c$ 55, the actual preferred hardness depends upon various factors such as the intended environment in which the track chain will be used, such as rocky terrain etc. Preferably the Rockwell hardness of the rail portion is about $R_c$50 when measured up to a depth in the range of about 7 mm to about 25 mm from the surface and the rail portion has a martensitic microstructure up to a depth in the range of about 7 mm to about 25 mm desirably.

INDUSTRIAL APPLICABILITY

A most significant savings of time, labor, resources and equipment is that through the process of this invention, a track chain link is selectively hardened by controlled spraying of quenchant in a single quenching step to obtain predetermined levels of hardnesses in the rail and pad portions of the track link. Any additional temper in the rail portion is attained by the residual heat in the pad portion, without the need for furnace tempering.

The process of the present invention is particularly useful for hardening forged track chain links for the tracks of a track-type vehicle.

Other aspects, objects and advantages of this invention can be obtained from a study of the disclosure, the drawings and the appended claims.

We claim:

1. A process for selectively hardening a forged track chain link, comprising the steps of:

providing a forged track chain link having a pad portion, a rail portion, a first side portion, and a second side portion;

providing a quench tank adapted for receiving said track chain link, said quench tank being adapted for spraying one or more of said track chain link portions with a quenchant at a controlled amount of one or more of a plurality of quenchant flow rates, a plurality of quenchant pressures and a plurality of quench times;

positioning said forged track chain link within said quench tank;

spraying one or more of said pad portion, said rail portion, said first side portion and said second side portion, with said quenchant at a controlled amount of one or more of a plurality of quenchant flow rates, a plurality of quenchant pressures and a plurality of quench times; wherein said pad portion is sprayed with quenchant at a quenchant flow rate in the range of about 10 g.p.m. to about 50 g.p.m., at a quenchant pressure in the range of about 2 psi to about 5 psi, and at a quench time in the range of about 1 second to about 15 seconds, and said rail portion is sprayed with quenchant at a quenchant flow rate in the range of about 70 gpm to about 100 gpm, at a quenchant pressure in the range of about 5 psi to about 15 psi, and at a quench time in the range of about 90 seconds to about 210 seconds; and simultaneously hardening said rail portion and said pad portion to respective surface hardnesses, said rail portion being hardened to a surface hardness greater than the surface hardness of said pad portion, said pad portion having a tempered martensitic microstructure up to a depth in the range of about 3 mm to about 12 mm from the surface, and a surface hardness in the range of about $R_c$ 33 to about $R_c$ 41, and said rail portion having a martensitic microstructure up to a depth in the range of about 7 mm to about 25 mm from the surface, and a surface hardness of at least $R_c$50.

2. A process, as set forth in claim 1, wherein the step of providing a forged track link includes providing said forged track chain link having an austenitic microstructure.

3. A process, as set forth in claim 1, wherein the step of providing a forged track link includes providing a track link wherein each of said pad portion, said rail portion, said first side portion and said second side portion of said track chain link include a bushing section, a strut section, and a pin section respectively.

4. A process, as set forth in claim 3, including spraying each of said bushing, strut and pin sections respectively of said pad, rail, first side and second side portions of said track chain link with said quenchant.

5. A process, as set forth in claim 4, including spraying at a controlled amount of one or more of a plurality of quenchant flow rates, a plurality of quenchant pressures and a plurality of quench times.

6. A process, as set forth in claim 5, wherein each of said bushing, strut and pin sections of said pad portion respectively are sprayed with quenchant at a quenchant flow rate in the range of about 10 g.p.m. to about 50 g.p.m., at a quenchant pressure in the range of about 2 psi to about 5 psi, and at a quench time in the range of about 1 second to about 15 seconds.

7. A process, as set forth in claim 6, wherein said bushing section is sprayed for a quench time in the range of about 1 second to about 5 seconds, said strut section is sprayed for a quench time in the range of about 9 seconds to about 15 seconds, and said pin section is sprayed for a quench time in the range of about 3 seconds to about 8 seconds.

8. A process, as set forth in claim 7, wherein said bushing, strut and pin sections of said pad portion respectively have surface temperatures in the range of from about 190° F. to about 310° F., from about 150° F. to about 195° F., and from about 195° F. to about 245° F. respectively and said pad portion has a martensitic microstructure at time "t" immediately after being sprayed with said quenchant.

9. A process, as set forth in claim 8, wherein said track chain link is removed from said quench tank and after a period of time in the range of about (t+5) minutes to about (t+10) minutes, the surface temperature of the pad portion is in the range of about 750° F. to about 950° F.

10. A process, as set forth in claim 5, wherein each of said bushing, strut and pin sections of said rail portion respectively are sprayed with quenchant at a quenchant flow rate in the range of about 70 gpm to about 100 gpm, at a quenchant pressure in the range of about 5 psi to about 15 psi, and at a quench time in the range of about 90 seconds to about 210 seconds.

11. A process, as set forth in claim 10, wherein said bushing section is sprayed for a quench time in the range of about 90 seconds to about 110 seconds, said strut section is sprayed for a quench time in the range of about 155 seconds to about 185 seconds, and said pin section is sprayed for a quench time in the range of about 190 seconds to about 210 seconds.

12. A process, as set forth in claim 11, wherein said rail portion has a surface temperature in the range of from about 105° F. to about 145° F. and a martensitic microstructure at time "t" immediately after being sprayed with said quenchant.

13. A process, as set forth in claim 12, wherein said track chain link is removed from said quench tank and after a period of time in the range of about (t+5) minutes to about (t+10) minutes, the surface temperature of the rail portion is in the range of about 250° F. to about 400° F.

14. A process, as set forth in claim 5, wherein each of said bushing, strut and pin sections of said first side portion and said second side portion respectively are sprayed with quenchant at a quenchant flow rate in the range of about 30 gpm to about 60 gpm, at a quenchant pressure in the range of about 1 psi to about 10 psi, and at a quench time in the range of about 1 second to about 15 seconds.

15. A process, as set forth in claim 14, wherein each of said bushing sections of said first and second side portions respectively are sprayed for a quench time in the range of about 1 second to about 5 seconds, each of said strut sections of said first and second side portions respectively are sprayed for a quench time in the range of about 9 seconds to about 15 seconds, and each of said pin sections of said first and second side portions respectively are sprayed for a quench time in the range of about 3 seconds to about 8 seconds.

16. A process, as set forth in claim 1, wherein the step of providing a quench tank includes providing a quench tank adapted for distributing said quenchant to a plurality of quench zones and providing said quenchant to each quench zone with a controlled amount of one or more of quenchant flow rate, quenchant pressure and quench time.

17. A process, as set forth in claim 16, wherein the step of providing a quench tank includes providing a quench tank adapted for distributing said quenchant to twelve quench zones.

18. A process, as set forth in claim 17, including a step of distributing said quenchant to twelve quench zones such that first, second and third quench zones are the bushing section, the strut section and the pin section of said pad portion respectively, fourth, fifth and sixth quench zones are the bushing section, the strut section and the pin section of said rail portion respectively, seventh, eight and ninth quench zones are the bushing section, the strut section and the pin section of said first side portion respectively, and tenth, eleventh and twelfth quench zones are the bushing section, the strut section and the pin section of said second side portion respectively.

19. A process, as set forth in claim 1, including providing said forged track chain link having a temperature in the range of about 1500° F. to about 1700° F.

20. A process, as set forth in claim 1, wherein said quenchant has a temperature in the range of about 90° F. to about 120° F.

21. A process, as set forth in claim 20, wherein said quenchant has a temperature in the range of about 93° F. to about 98° F.

22. A process, as set forth in claim 1, wherein said quenchant is one of water, organic heat transfer fluid, polymeric heat transfer fluid, or mixtures thereof.

23. A process, as set forth in claim 1, wherein said quenchant is a mixture of water and polyalkylene glycol.

* * * * *